US010055923B2

(12) United States Patent
Xu et al.

(10) Patent No.: US 10,055,923 B2
(45) Date of Patent: Aug. 21, 2018

(54) BANKNOTE SORTING APPARATUS AND CONTROL METHOD THEREFOR

(71) Applicant: SHANDONG NEW BEIYANG INFORMATION TECHNOLOGY CO., LTD., Shandong (CN)

(72) Inventors: Chunkai Xu, Shandong (CN); Yueqi Xing, Shandong (CN); Lianfeng Zhang, Shandong (CN); Bingqing Liu, Shandong (CN)

(73) Assignee: SHANDONG NEW BEIYANG INFORMATION TECHNOLOGY CO., LTD. (CN)

( * ) Notice: Subject to any disclaimer, the term of this patent is extended or adjusted under 35 U.S.C. 154(b) by 0 days.

(21) Appl. No.: 15/562,601

(22) PCT Filed: Mar. 1, 2016

(86) PCT No.: PCT/CN2016/075161

§ 371 (c)(1),
(2) Date: Sep. 28, 2017

(87) PCT Pub. No.: WO2016/155449

PCT Pub. Date: Oct. 6, 2016

(65) Prior Publication Data

US 2018/0114394 A1 Apr. 26, 2018

(30) Foreign Application Priority Data

Mar. 31, 2015 (CN) ..... 2015 1 0148622

(51) Int. Cl.
*G07F 7/04* (2006.01)
*G07D 11/00* (2006.01)
(Continued)

(52) U.S. Cl.
CPC ..... *G07D 11/0084* (2013.01); *G07D 7/183* (2017.05); *G07D 7/185* (2013.01);
(Continued)

(58) Field of Classification Search
CPC ... B65H 2701/1912; G06K 2017/0038; G07D 7/00; G07D 7/181; G07D 7/206; G07D 11/0084; G07F 7/04
See application file for complete search history.

(56) References Cited

U.S. PATENT DOCUMENTS 6,913,130 B1 7/2005 Mazur et al.
2008/0289929 A1* 11/2008 Wilfer ..... G07D 11/0036 194/302

(Continued)

FOREIGN PATENT DOCUMENTS

CN 102341829 A 2/2012
CN 1034004-44 A 11/2013

(Continued)

OTHER PUBLICATIONS

Patent Cooperation Treaty (PCT), International Search Report and Written Opinion for Application PCT/CN2016/075161 filed Mar. 1, 2016, dated Jun. 7, 2016 International Searching Authority, CN, (6 pages).

*Primary Examiner* — Mark J Beauchaine
(74) *Attorney, Agent, or Firm* — McDonald Hopkins LLC

(57) ABSTRACT

A banknote sorting apparatus and a control method therefor are provided. The control method for the banknote sorting apparatus includes: obtaining a characteristic value of a standard template, wherein the standard template is a preset banknote template satisfying a set condition, and the characteristic value is a characteristic value for banknote classification; and displaying the characteristic value and an original sorting parameter corresponding to the characteris- (Continued)

tic value, wherein the original sorting parameter is a sorting parameter preset in the banknote sorting apparatus.

10 Claims, 6 Drawing Sheets

(51) Int. Cl.
*G07D 7/187* (2016.01)
*G07D 7/185* (2016.01)
*G07D 7/183* (2016.01)

(52) U.S. Cl.
CPC ..... *G07D 7/187* (2013.01); *G07D 11/0018* (2013.01); *G07D 11/0033* (2013.01); *G07D 2211/00* (2013.01)

(56) References Cited

U.S. PATENT DOCUMENTS

2012/0041590 A1 2/2012 Ozaki et al.
2015/0310268 A1* 10/2015 He ..... G06K 9/6215
382/135

FOREIGN PATENT DOCUMENTS

CN 103413377 A 11/2013
CN 103778711 A 5/2014
CN 204117246 U 1/2015
WO 2010116114 A1 10/2010

* cited by examiner

| | | | |
|---|---|---|---|
| Original sorting parameter 1 | 15 | Original sorting parameter 2 | 100 |
| characteristic value 1 of standard template | 20 | characteristic value 2 of standard template | 125 |
| Original sorting parameter 3 | 80 | Original sorting parameter 4 | 210 |
| characteristic value 3 of standard template | 98 | characteristic value 4 of standard template | 180 |
| . | | . | |
| . | | . | |
| . | | . | |
| . | | . | |
| . | | . | |
| Original sorting parameter n-1 | 60 | Original sorting parameter n | 130 |
| characteristic value n-1 of standard template | 82 | characteristic value n of standard template | 145 |

Whether determine to set the original sorting parameter?

OK Cancel

FIG.4

BANKNOTE SORTING APPARATUS AND CONTROL METHOD THEREFOR

CROSS-REFERENCE TO RELATED APPLICATION

This application is a 35 U.S.C. 371 national stage filing of PCT Application No. PCT/CN2016/075161 filed on Mar. 1, 2016, which claims priority to Chinese Patent Application No. 201510148622.3 filed on Mar. 31, 2015, each of which are incorporated herein in their entirety by reference.

TECHNICAL FIELD

The present disclosure relates to the field of banknote processing, and particularly relates to a banknote sorting apparatus and a control method therefor.

BACKGROUND

A banknote sorting apparatus (referred to as sorting apparatus for short) is used for sorting and classifying banknotes put into a banknote inlet according to a sorting parameter set by a user so that banknotes in the banknote inlet are conveyed to different banknote outlets according to user needs. The sorting parameter includes currency type, denominations, orientations and versions of banknotes, as well as characteristic values for reflecting the quality of banknotes, such as brightness values, pollution degree values and the like of banknotes.

In general, a manufacturer of the sorting apparatus uniformly configures the sorting parameter of the sorting apparatus as a default value (hereinafter referred to as an original sorting parameter) before the sorting apparatus leaves a factory. However, since different financial institutions have different sorting demands, banks and other final institutions generally need professional operators to reset the sorting parameters of the sorting apparatuses according to banknote classification needs of the financial institutions after purchasing the sorting apparatuses. For example, the operator of one financial institution sets the sorting parameter so that the sorting apparatus sorts and recycles banknotes less than 70% new as banknotes unsuitable for circulation. In an existing art, the operator firstly sets the sorting parameter according to a preset standard template which is a banknote satisfying a set condition, then estimates the characteristic value of the standard template by visual observation, and sets the sorting parameter of the sorting apparatus according to the characteristic value. The banknote classification need of the financial institution needs to be determined jointly by multiple standard templates. For example, when the financial institution sorts and recycles banknotes less than 70% new as banknotes unsuitable for circulation, conditions of banknotes are affected by parameters that reflect the quality of banknotes; the parameters that reflect the quality of banknotes include the brightness value, the pollution value, a graffiti value, a fold length, a crease length, a hole diameter, a broken corner area, a folded corner area, a tear length, a missing edge length and the like; and therefore, when the sorting parameters are set, all parameters that reflect the quality of banknotes must be set to determine the conditions of banknotes. However, these parameters are hard to be embodied on one standard template (i.e., one banknote). The sorting parameters of the sorting apparatus need to be determined jointly by a plurality of standard templates in the existing art. For example, a standard template 1 is used for determining the brightness value of the banknote; a second template 2 is used for determining the pollution degree value of the banknote; and a standard template 3 is used for determining the diameter of the hole in the banknote, etc. When the sorting parameters of the sorting apparatus are set, the operator estimates the characteristic value of each standard template by visually observing the standard template, and assigns values to the sorting parameters by an input apparatus of the sorting apparatus.

As the above parameters are difficult to be quantified, the operator hardly distinguishes the difference between the characteristic value of the standard template and a value of the original sorting parameter through visual observation, thereby causing great difficulty in setting sorting apparatus parameters. In addition, since a process of estimating the characteristic value of the standard template by visual observation is greatly influenced by personal observation ability and work experience of the operator, for the same standard template, the characteristic values of the standard template obtained by visual observation by different operators are different. Therefore, the process of estimating the characteristic value of the standard template by visual observation may cause poor parameter setting consistency of the sorting apparatus, thereby resulting in inaccurate sorting and classification results of the sorting apparatus.

With respect to the problem of great difficulty in setting the sorting apparatus parameters in the existing art, no effective solution is put forward at present.

SUMMARY

The main purpose of embodiments of the present disclosure is to provide a banknote sorting apparatus and a control method therefor, so as to solve a problem of great difficulty in setting sorting apparatus parameters in an existing art.

In order to achieve the above purpose, according to one aspect of embodiments of the present disclosure, a control method for a banknote sorting apparatus is provided. The method includes: obtaining a characteristic value of a standard template, wherein the standard template is a preset banknote template satisfying a set condition, and the characteristic value is a characteristic value for banknote classification; and displaying the characteristic value and an original sorting parameter corresponding to the characteristic value, wherein the original sorting parameter is a sorting parameter preset in the banknote sorting apparatus.

The obtaining the characteristic value of the standard template may include: collecting at least one of image data and magnetic data of the standard template; and performing analytical processing on at least one of the image data and/or the magnetic data to obtain the characteristic value of the standard template.

The displaying the characteristic value and the original sorting parameter corresponding to the characteristic value may include: displaying the characteristic value and the original sorting parameter corresponding to the characteristic value in groups, wherein each group of displayed contents includes one characteristic value and an original sorting parameter corresponding to the characteristic value.

After obtaining the characteristic value of the standard template, the method may include: comparing the characteristic value with the original sorting parameter corresponding to the characteristic value. The displaying the characteristic value and the original sorting parameter corresponding to the characteristic value may include: displaying the characteristic value and the original sorting parameter corresponding to the characteristic value if a difference value between the characteristic value and the original sorting parameter corresponding to the characteristic value exceeds a preset value.

When displaying the characteristic value and the original sorting parameter corresponding to the characteristic value, the displayed characteristic value is in an editable state. After displaying the characteristic value in the editable state, the method may include: outputting prompt message, wherein the prompt message is used for prompting whether to set the original sorting parameter; receiving input information, wherein the input information includes a characteristic value after editing and modifying the characteristic value in the editable state; and setting the original sorting parameter according to the input information.

In order to achieve the above purpose, according to another aspect of embodiments of the present disclosure, a banknote sorting apparatus is provided. A conveying passage for conveying banknotes is arranged in the banknote sorting apparatus. The banknote sorting apparatus includes: a banknote inlet arranged at a starting end of the conveying passage and configured to stack banknotes to be classified; a first banknote outlet connected with the conveying passage through a first banknote outing passage and configured to accumulate first kind of banknotes obtained by sorting according to a sorting parameter; a second banknote outlet located downstream of the first banknote outlet along a banknote conveying direction, connected with the conveying passage through a second banknote outing passage and configured to accumulate second kind of banknotes obtained by sorting according to the sorting parameter; a control unit for obtaining a characteristic value of a standard template, wherein the standard template is a preset banknote template satisfying a set condition, and the characteristic value is a characteristic value for banknote classification; and a human-machine interaction unit, wherein the human-machine interaction unit includes a display unit for displaying the characteristic value and an original sorting parameter corresponding to the characteristic value, and the original sorting parameter is a sorting parameter preset in the banknote sorting apparatus.

The banknote sorting apparatus may include: a collection unit configured to collect at least one of image data and magnetic data of conveyed banknotes; and the control unit is configured to perform analytical processing on at least one of the image data and the magnetic data to obtain the characteristic value of the standard template.

The display unit is configured to display the characteristic value and the original sorting parameter corresponding to the characteristic value in groups, wherein each group of displayed contents includes one characteristic value and an original sorting parameter corresponding to the characteristic value.

The control unit is configured to compare the characteristic value with the original sorting parameter corresponding to the characteristic value. The display unit is configured to display the characteristic value and the original sorting parameter corresponding to the characteristic value when a difference value between the characteristic value and the original sorting parameter corresponding to the characteristic value exceeds a preset value.

The display unit is configured to display a characteristic value in an editable state when displaying the characteristic value and the original sorting parameter corresponding to the characteristic value. The human-machine interaction unit is configured to output prompt message and receive input information, wherein the prompt message is used for prompting whether to set the original sorting parameter; and the input information includes a characteristic value after editing and modifying the characteristic value in the editable state. The control unit is configured to set the original sorting parameter according to the input information.

Through embodiments of the present disclosure, since the characteristic value of the standard template is obtained and the characteristic value of the standard template and the original sorting parameter corresponding to the characteristic value are displayed, the problem of great difficulty in setting the sorting apparatus parameter in the existing art is solved, thereby achieving an effect of setting the original sorting parameter of the sorting apparatus more accurately.

BRIEF DESCRIPTION OF DRAWINGS

Drawings that form part of the present application are used for providing a further understanding of the present disclosure. Illustrative embodiments of the present disclosure and descriptions thereof are used for explaining the present disclosure, rather than forming an improper limitation to the present disclosure. In the drawings:

FIG. 4 is a schematic diagram illustrating display results of a characteristic value of a standard template and an original sorting parameter according to an embodiment of the present disclosure;

DETAILED DESCRIPTION

It should be noted that embodiments in the present application and features in embodiments can be combined with each other without conflict. The present disclosure will be described in detail below with reference to drawings and in combination with embodiments.

In order to allow those skilled in the art to better understand solutions of the present application, technical solutions in the embodiments of the present application will be described clearly and completely in combination with the drawings in embodiments of the present application. Apparently, the described embodiments are only portion of embodiments of the present application, and not all embodiments. All other embodiments obtained by those ordinary skilled in the art without contributing creative work based on embodiments in the present application should belong to a protection scope of the present application.

It should be noted that terms such as "first", "second" and the like in description and claims of the present application and the above drawings are used for distinguishing similar objects, rather than describing a specified sequence or order. It should be understood that data used in this way are interchangeable in appropriate situations so as to conveniently describe embodiments of the present application herein. In addition, the terms "include" and "have" as well as any variation thereof are intended to cover non-exclusive inclusion. For example, processes, methods, systems, products or devices including a series of steps or units do not need to be limited to the clearly listed steps or units, but may include other steps or units which are not listed clearly or inherent to the processes, methods, products or devices.

Figure 1:
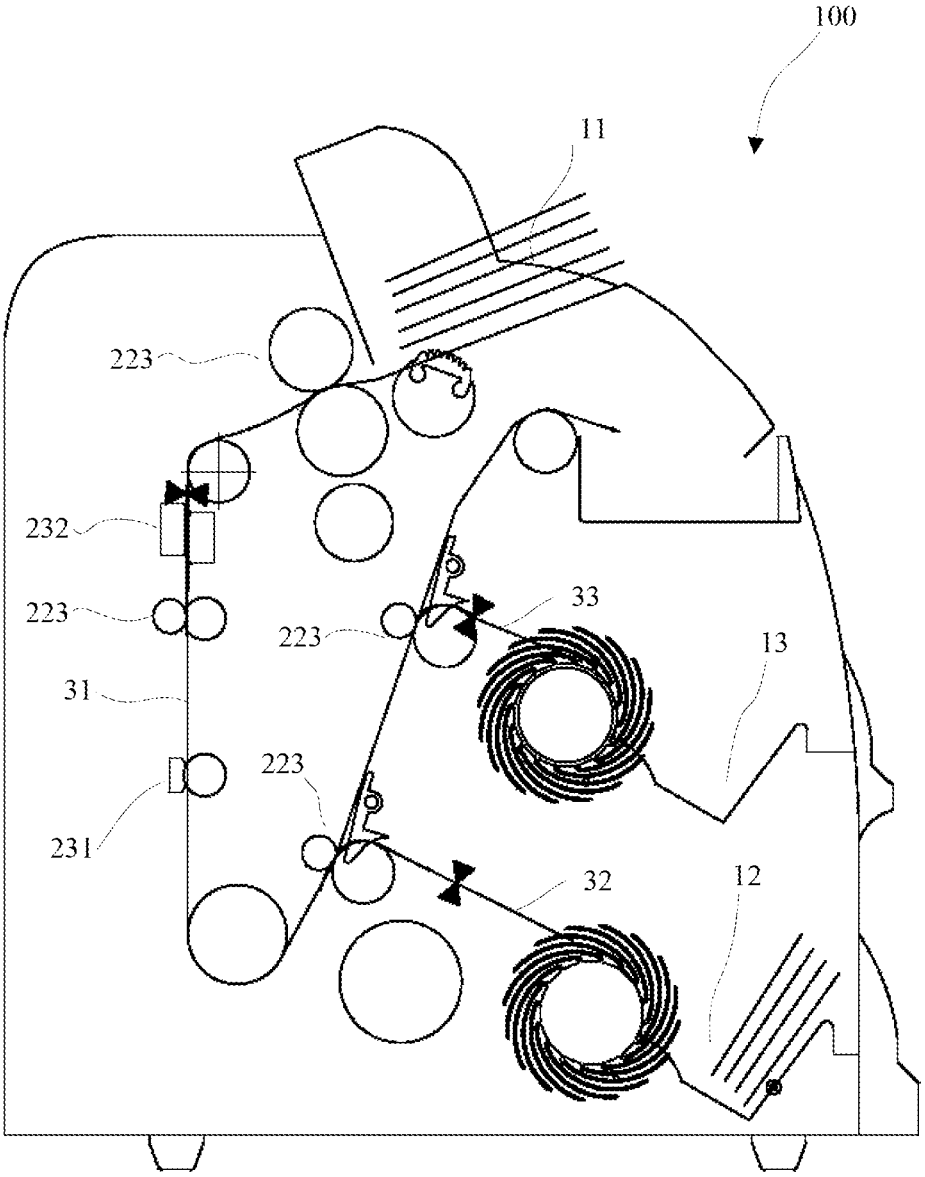
FIG. 1 is a schematic structural diagram illustrating a sorting apparatus according to embodiments of the present disclosure.

FIG. 1 is a schematic structural diagram illustrating a sorting apparatus according to embodiments of the present disclosure. As shown in the figure, the sorting apparatus 100 includes a banknote inlet 11, a first banknote outlet 12 and a second banknote outlet 13. The sorting apparatus 100 is configured to classify banknotes according to a sorting parameter. The sorting apparatus 100 has a conveying passage 31 for conveying banknotes. The banknote inlet 11 is arranged at a starting end of the conveying passage 31 and is configured to stack banknotes to be sorted. The first banknote outlet 12 is connected with the conveying passage 31 through a first banknote outing passage 32 and is configured to accumulate first kind of banknotes, such as banknotes suitable for circulation, obtained by sorting according to the sorting parameter. The second banknote outlet 13 is located downstream of the first banknote outlet 12 along a banknote conveying direction. The second banknote outlet 13 is connected with the conveying passage 31 through a second banknote outing passage 33 and is configured to accumulate second kind of banknotes, such as banknotes unsuitable for circulation, obtained by sorting according to the sorting parameter.

Figure 2:
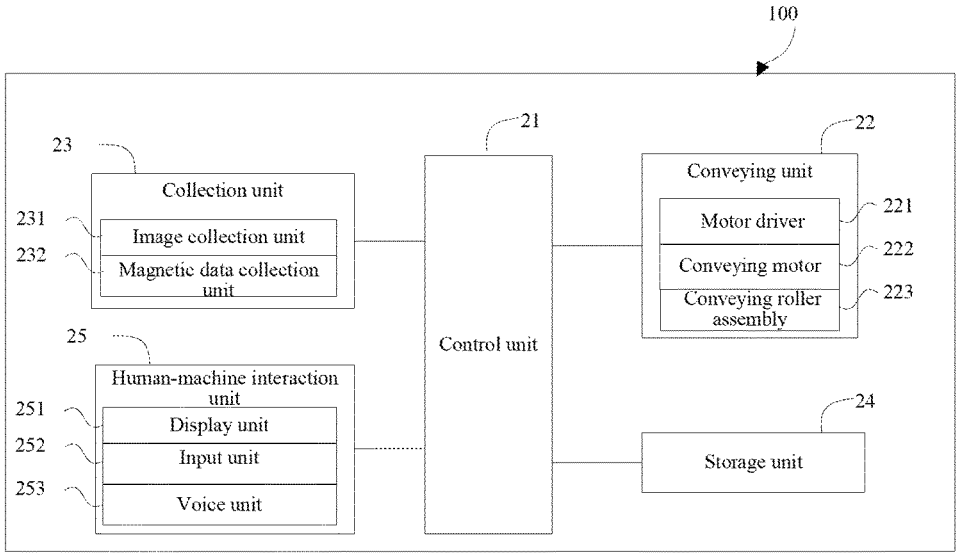
FIG. 2 is a schematic modular diagram illustrating a sorting apparatus according to embodiments of the present disclosure.

FIG. 2 is a schematic modular diagram illustrating a sorting apparatus according to embodiments of the present disclosure. As shown in the figure, the sorting apparatus 100 further includes a control unit 21, a conveying unit 22, a collection unit 23, a storage unit 24 and a human-machine interaction unit 25.

The control unit 21 is configured to control each module to operate. For example, the control unit 21 controls the conveying unit 22 to drive banknotes to move in the conveying passage and the banknote outing passage of the sorting apparatus 100. The control unit 21 controls the collection unit 23 to collect image data and magnetic data and the like of banknotes.

The conveying unit 22 is configured to drive banknotes to move in the conveying passage and the banknote outing passage of the sorting apparatus 100 so that banknotes are conveyed from the banknote inlet 11 to a set banknote outlet, such as the first banknote outlet 12 or the second banknote outlet 13. The conveying unit 22 includes a motor driver 221, a conveying motor 222 and conveying roller assemblies 223, wherein the conveying roller assemblies 223 are arranged in the conveying passage and the banknote outing passage. The motor driver 221 is configured to output current required for rotation of an output shaft of the conveying motor 222 according to a control signal output by the control unit 21. The output shaft of the conveying motor 222 is in transmission connection with the conveying roller assemblies 223. When the output shaft of the conveying motor 222 rotates, the conveying roller assemblies 223 rotate along with the output shaft of the conveying motor 222 to drive banknotes to move in the conveying passage and the banknote outing passage.

The collection unit 23 is configured to collect characteristic information of conveyed banknotes. The collection unit 23 is arranged in the conveying passage 31 of the banknote sorting apparatus 100 and includes an image collection unit 231 and a magnetic data collection unit 232. The image collection unit 231 may be a Contact Image Sensor (CIS) or a Charge-Coupled Device (CCD) for collecting image data of both front surface and back surface of a banknote. The image data of banknotes include visible image data, ultraviolet image data, infrared image data and the like. The magnetic data collection unit 232 is a magnetic head for collecting magnetic data on banknotes, for example, acquiring magnetic data and the like related to magnetic characters on banknotes.

The storage unit 24 is configured to store a control program and an original sorting parameter group of the sorting apparatus 100. The original sorting parameter group includes one or more preset original sorting parameters. Each original sorting parameter corresponds to a characteristic value of a banknote for banknote classification. When banknotes stacked in the banknote inlet 11 are sorted and classified, if a comparison result of the characteristic value for banknote classification (hereinafter referred to as characteristic value) and an original sorting parameter corresponding to the characteristic value satisfies certain preset condition, banknotes are conveyed to a banknote outlet corresponding to the preset condition. For example, if certain characteristic value of banknotes is greater than an original sorting parameter corresponding to the characteristic value, banknotes are judged as banknotes unsuitable for circulation, and banknotes are conveyed to the second banknote outlet 13. The control unit 21 calculates a characteristic value of banknotes according to the image data and the magnetic data of banknotes collected by the collection unit 23. The characteristic value of banknotes includes currency type, denomination, orientation, version, banknote quality characteristic value and the like of banknotes, or includes one or more characteristic values of currency type, denomination, orientation, version and banknote quality characteristic value of banknotes. The banknote quality characteristic value includes brightness value, pollution value, graffiti value, fold length, crease length, hole diameter, broken corner area, folded corner area, tear length, missing edge length and the like of banknotes, or include any one or more characteristic values of brightness value, pollution value, graffiti value, fold length, crease length, hole diameter, broken corner area, folded corner area, tear length and missing edge length of banknotes. Each banknote quality characteristic value can be classified into multiple classes. An original sorting parameter corresponding to the banknote quality characteristic value is one fixed class of the multiple classes. For example, the brightness value of the banknote is classified into 256 classes; and if the 256 classes of the brightness values are 0, 1, 2, . . . , 255, the original sorting parameter corresponding to the brightness value of the banknote is one fixed value within a range of 0-255.

The human-machine interaction unit 25 is configured to output operation information to an operator and receive input information of the operator. The human-machine interaction unit 25 includes a display unit 251, an input unit 252 and a voice unit 253. The display unit 251 is a display screen for displaying an operation result of the sorting apparatus 100. The input unit 252 is a keyboard or a touch button for receiving operation information input by the operator. The voice unit 253 is configured to prompt the operator to operate in a way of voice.

Embodiments of the present disclosure further provide a control method for a sorting apparatus. The control method for the sorting apparatus provided by embodiments of the present disclosure can be realized by the sorting apparatus provided by embodiments of the present disclosure.

Figure 3:
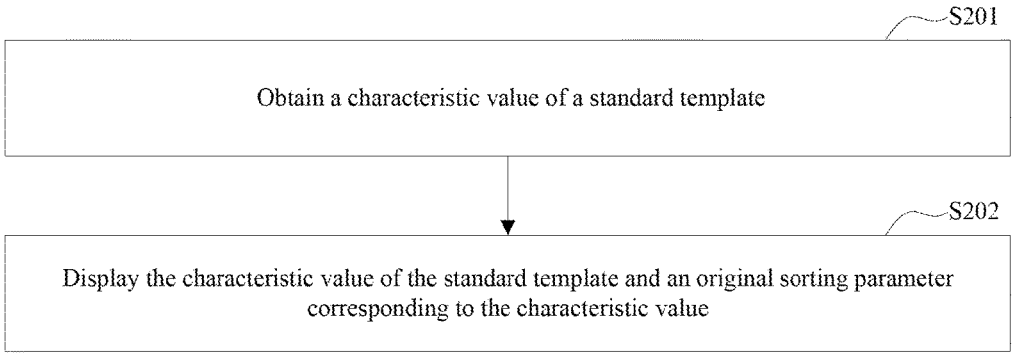
FIG. 3 is a flow chart illustrating a control method for a sorting apparatus according to an embodiment of the present disclosure.

FIG. 3 is a flow chart illustrating a control method for the sorting apparatus according to an embodiment of the present disclosure. The sorting apparatus performs the flow in a parameter setting mode. As shown in the figure, the method includes steps S201 and S202.

In step S201, a characteristic value of a standard template is obtained.

The characteristic value of the standard template is obtained. The characteristic value is a characteristic value used for banknote classification. The standard template is a preset banknote template satisfying a preset condition, and may be the banknote itself. For example, the standard template is a banknote approved by a financial institution and satisfying a condition of 70% new. In the present embodiment, the conveying unit 22 drives the standard template to move in the conveying passage 31 of the sorting apparatus. When the standard template passes through the collection unit 23, the collection unit 23 collects image data and magnetic data of the standard template; and the control unit 21 performs analytical processing on the image data and the magnetic data collected by the collection unit 23 and calculates the characteristic value of the standard template, wherein the characteristic value of the standard template includes currency type, denomination, orientation, version, banknote quality characteristic value and the like of the standard template; and the banknote quality characteristic value includes brightness value, pollution value, graffiti value, fold length, crease length, hole diameter, broken corner area, folded corner area, tear length, missing edge length and the like of banknotes.

In step S202, the characteristic value of the standard template and the original sorting parameter corresponding to the characteristic value are displayed.

The control unit 21 transmits the characteristic value of the standard template and the original sorting parameter corresponding to the characteristic value to the display unit 251, and the characteristic value of the standard template and the original sorting parameter corresponding to the characteristic value are displayed on the display unit 251. In actual application, the original sorting parameter can be pre-stored in the storage unit 24.

FIG. 4 is a schematic diagram illustrating display results of the characteristic value of the standard template and the original sorting parameter according to an embodiment of the present disclosure. As shown in the figure, the display unit 251 displays characteristic values of the standard template and original sorting parameters in groups. Each group of displayed contents includes one characteristic value of the standard template and an original sorting parameter corresponding to the characteristic value.

It should be noted that the display unit 251 can display all obtained characteristic values of the standard template and original sorting parameters corresponding to all the characteristic values one by one in groups, and can also display portion of the obtained characteristic values of the standard template satisfying a preset condition and original sorting parameters corresponding to the portion of the characteristic values one by one. In an embodiment shown in FIG. 4, a characteristic value 1 of the standard template is 20, and a corresponding original sorting parameter 1 is 15; a characteristic value 2 of the standard template is 125, and a corresponding original sorting parameter 2 is 100; a characteristic value 3 of the standard template is 98, and a corresponding original sorting parameter 3 is 80; a characteristic value 4 of the standard template is 180, and a corresponding original sorting parameter 4 is 210; . . . , a characteristic value n−1 of the standard template is 82, and a corresponding original sorting parameter n−1 is 60; and a characteristic value n of the standard template is 145, and a corresponding original sorting parameter n is 130. As shown in FIG. 4, if the operator chooses "Cancel", it indicates that the original sorting parameter does not need to be reset. If the operator chooses "OK", it indicates that the original sorting parameter needs to be reset, and information input can be performed to set the original sorting parameter at this time.

In the control method for the sorting apparatus of the present embodiment, since the sorting apparatus acquires the characteristic value of the standard template and displays the characteristic value of the standard template and the original sorting parameter corresponding to the characteristic value, the operator can obtain the characteristic value of the standard template without visually observing the standard template. The control method for the sorting apparatus of the present embodiment can effectively solve problems of great operation difficulty and inaccurate sorting and classification result when the operator sets the sorting parameter of the sorting apparatus by estimating the characteristic value of the standard template by visual observation in the existing art.

Figure 5:
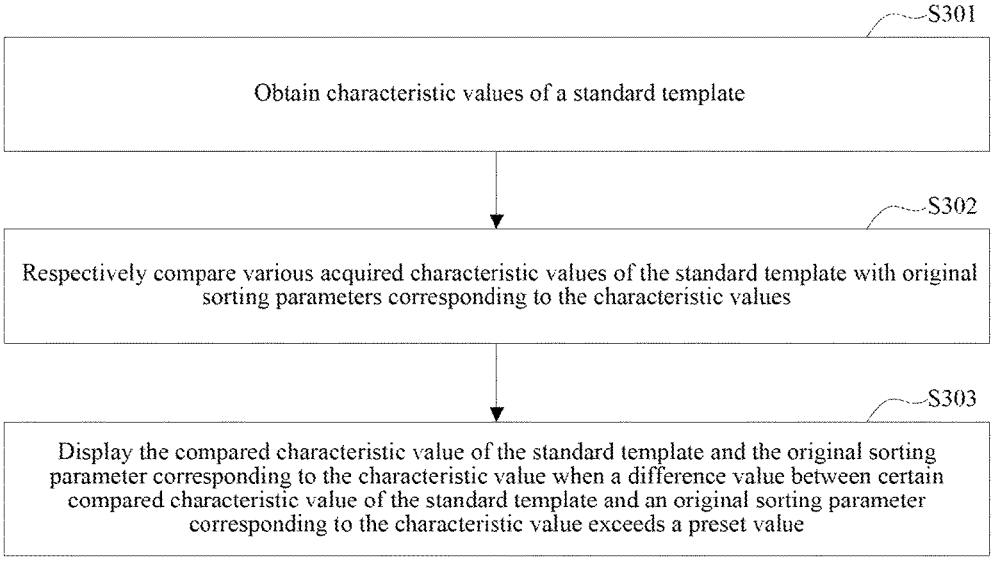
FIG. 5 is a flow chart illustrating a control method for a sorting apparatus according to another embodiment of the present disclosure.

FIG. 5 is a flow chart illustrating the control method for the sorting apparatus according to another embodiment of the present disclosure. As shown in the figure, the method includes steps S301 to S303.

In step S301, characteristic values of a standard template are obtained.

The step is same as the step S201.

In step S302, each obtained characteristic value of the standard template is compared with original sorting parameters corresponding to the characteristic values.

The control unit 21 sequentially compares each of the obtained characteristic values of the standard template with the original sorting parameter corresponding to the characteristic value. In actual application, the original sorting parameter can be pre-stored in the storage unit 24.

In step S303, when a difference value between certain compared characteristic value of the standard template and an original sorting parameter corresponding to the characteristic value exceeds a preset value, the compared characteristic value of the standard template and the original sorting parameter corresponding to the characteristic value are displayed.

The control unit 21 calculates the difference value between the compared characteristic value of the standard template and the original sorting parameter corresponding to the characteristic value, and judges whether the difference value between them exceeds the preset value. When the difference value between certain compared characteristic value of the standard template and the original sorting parameter corresponding to the characteristic value exceeds the preset value, the control unit 21 transmits the characteristic value of the standard template and the original sorting parameter corresponding to the characteristic value to the display unit 251, and the characteristic value of the standard template and the original sorting parameter corresponding to the characteristic value are displayed on the display unit 251.

In the control method for the sorting apparatus of the present embodiment, since the sorting apparatus displays the characteristic value of the standard template and the original sorting parameter corresponding to the characteristic value only when the difference value between the characteristic value of the standard template and the original sorting parameter corresponding to the characteristic value exceeds the preset value, the operator can obtain the characteristic value of the standard template different from the original sorting parameter without visually observing the standard template, and can easily determine the original sorting parameter different from the characteristic value of the standard template so as to determine an original sorting parameter required to be reset according to the standard template. The control method for the sorting apparatus of the present embodiment can effectively solve a problem of great operation difficulty when the operator needs to estimate the characteristic value of each standard template by visual observation in the existing art.

Figure 6:
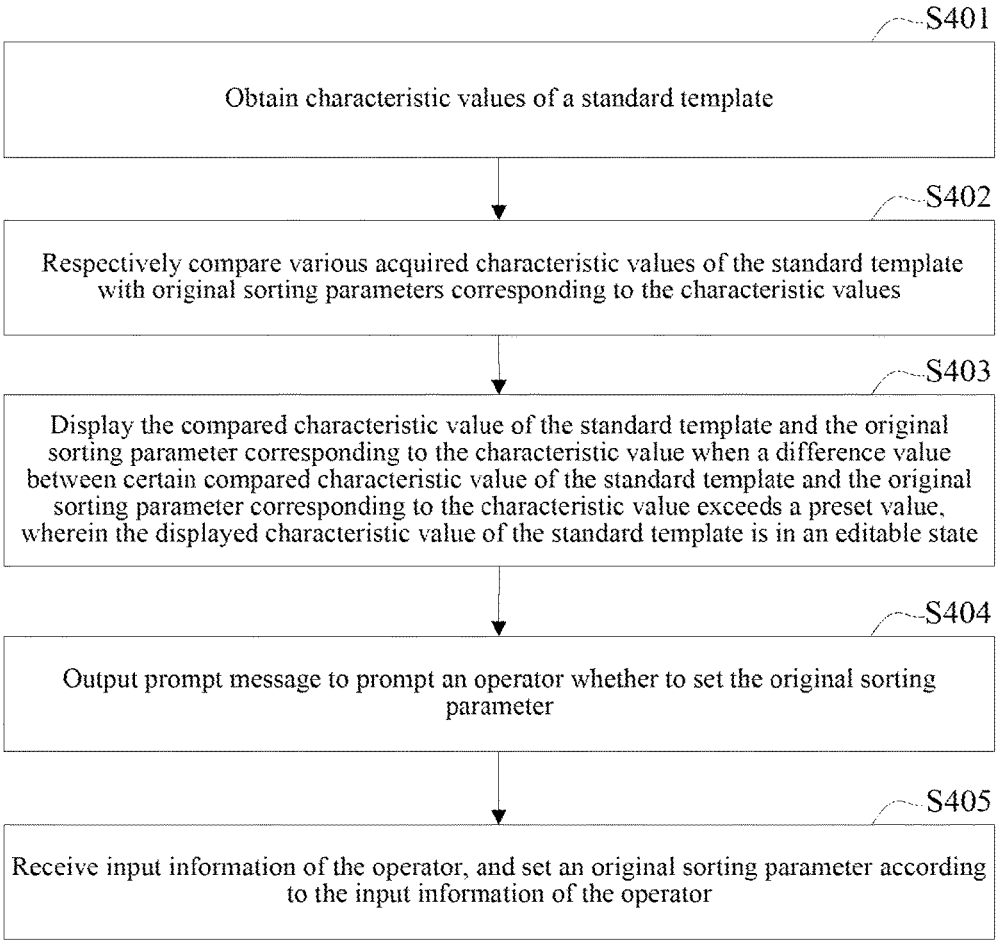
FIG. 6 is a flow chart illustrating a control method for a sorting apparatus according to still another embodiment of the present disclosure.

FIG. 6 is a flow chart illustrating the control method for the sorting apparatus according to another embodiment of the present disclosure. As shown in the figure, the method includes following steps S401 to S405.

Steps S401 to S402 are same as steps S301 to S302.

In step S403, when a difference value between certain compared characteristic value of the standard template and an original sorting parameter corresponding to the characteristic value exceeds a preset value, the compared characteristic value of the standard template and the original sorting parameter corresponding to the characteristic value are displayed, wherein the displayed characteristic value of the standard template is in an editable state.

When a difference value between certain compared characteristic value of the standard template and an original sorting parameter corresponding to the characteristic value exceeds the preset value, the control unit 21 transmits the characteristic value of the standard template and the original sorting parameter corresponding to the characteristic value to the display unit 251, and the characteristic value of the standard template and the original sorting parameter corresponding to the characteristic value are displayed on the display unit 251. Meanwhile, the characteristic value of the standard template displayed by the display unit 251 is in the editable state. The operator can edit and modify the displayed characteristic value of the standard template as needed.

Figure 7:
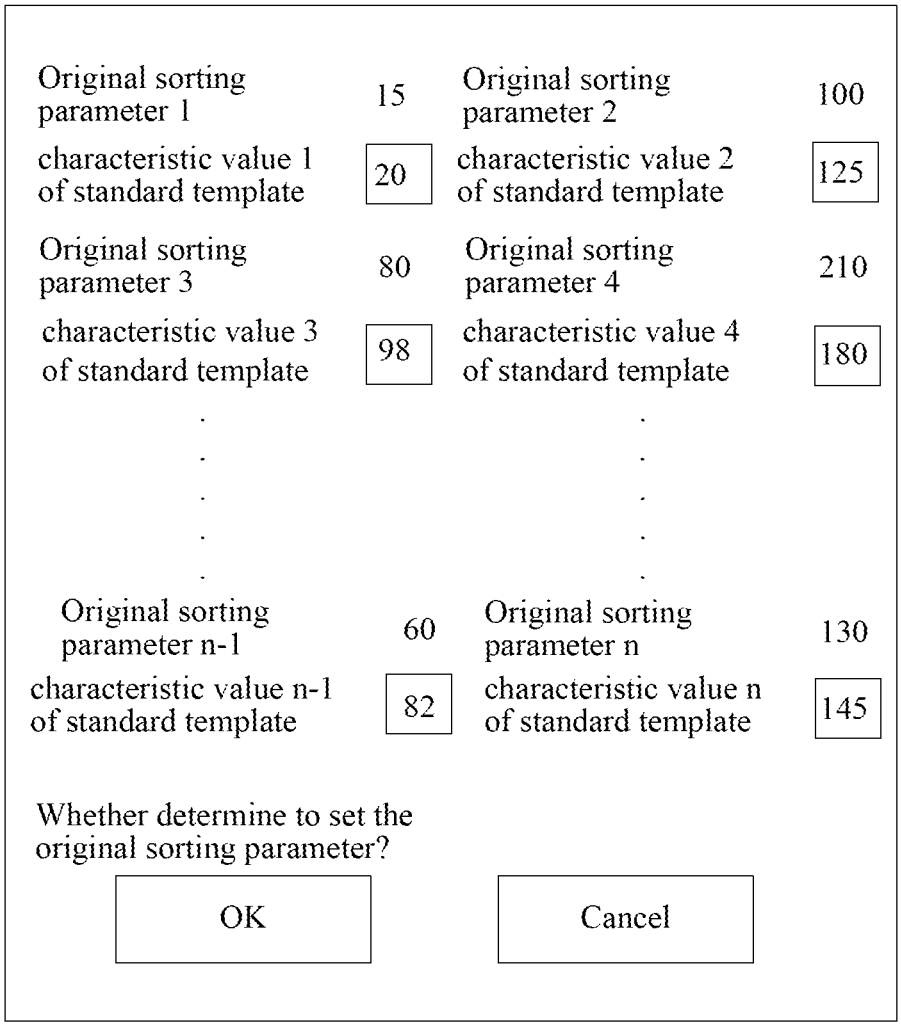
FIG. 7 is a schematic diagram illustrating display results of a characteristic value of a standard template and an original sorting parameter according to another embodiment of the present disclosure.

FIG. 7 is a schematic diagram illustrating display results of the characteristic value of the standard template and the original sorting parameter according to another embodiment of the present disclosure. As shown in the figure, the display unit 251 displays the characteristic value of the standard template and the original sorting parameter in groups. Each group of displayed contents includes one characteristic value of the standard template and the original sorting parameter corresponding to the characteristic value, wherein each of the displayed characteristic values of the standard template may be in the editable state; and the operator can edit and modify the displayed characteristic value of the standard template as needed. In the embodiment shown in FIG. 7, the characteristic value 1 of the standard template is 20, and the corresponding original sorting parameter 1 is 15; the characteristic value 2 of the standard template is 125, and the corresponding original sorting parameter 2 is 100; the characteristic value 3 of the standard template is 98, and the corresponding original sorting parameter 3 is 80; the characteristic value 4 of the standard template is 180, and the corresponding original sorting parameter 4 is 210; . . . , the characteristic value n−1 of the standard template is 82, and the corresponding original sorting parameter n−1 is 60; and the characteristic value n of the standard template is 145, and the corresponding original sorting parameter n is 130, wherein the characteristic value 1 of the standard template to the characteristic value n of the standard template are in the editable state.

In step S404, prompt message is output to prompt the operator regarding whether to set the original sorting parameter.

The control unit 21 controls the display unit 251 to display the prompt message or controls the voice unit 253 to issue a voice prompt for prompting the operator regarding whether to set the original sorting parameter. As shown in FIG. 7, the display unit 251 displays the prompt message of "whether determine to set the original sorting parameter?" so as to prompt the operator to determine to set the original sorting parameter or to cancel setting of the original sorting parameter. Further, the control unit 21 reminds the operator of whether to modify the displayed characteristic value of the standard template by outputting the prompt message.

In step S405, input information of the operator is received; and an original sorting parameter is set according to the input information of the operator.

The control unit 21 receives the operation information input by the operator through the input unit 252, and resets the original sorting parameter according to the input information of the operator. As shown in FIG. 7, the input information of the operator includes various characteristic values after editing and modifying the displayed characteristic values of the standard template. The operator can modify various characteristic values in the editable state displayed on the display unit 251 through the input unit 252. The input information of the operator further includes information of whether determine to set the original sorting parameter. If the operator chooses "Cancel", i.e., the sorting apparatus receives first input information, it indicates that the original sorting parameter does not need to be reset. If the operator chooses "OK", i.e., the sorting apparatus receives second input information, it indicates that the original sorting parameter needs to be reset. When the information of determining to set the original sorting parameter input by the operator is received, the control unit 21 resets an original sorting parameter according to the characteristic value of the standard template. For example, the control unit 21 clears away one original sorting parameter stored in the storage unit 24, and stores the characteristic value of the standard template corresponding to the original sorting parameter displayed on the display unit 251 onto a corresponding storage position of the storage unit 24, thereby resetting the original sorting parameter. When the operator edits and modifies the displayed characteristic value of the standard template, the control unit 21 resets the original sorting parameter according to the edited and modified characteristic value. When the operator does not edit and modify the displayed characteristic value of the standard template, the control unit 21 resets the original sorting parameter according to the obtained characteristic value of the standard template.

In the control method for the sorting apparatus of the present embodiment, the characteristic value of the standard template displayed by the sorting apparatus is in the editable state, so that the operator can appropriately modify the obtained characteristic value of the standard template according to the original sorting parameter and the obtained characteristic value of the standard template, and the sorting apparatus can set the original sorting parameter according to the modified characteristic value. The control method for the sorting apparatus of the present embodiment allows the original sorting parameter of the sorting apparatus to be set more flexibly and accurately.

The above contents are only embodiments of the present disclosure and are not used for limiting the present disclosure. For those skilled in the art, various changes and modifications can be made to the present disclosure. Any modification, equivalent replacement, improvement and the like made within spirits and principles of the present disclosure should be included in the protection scope of the present disclosure.

What is claimed is:

1. A control method for a banknote sorting apparatus, comprising:

obtaining a characteristic value of a standard template, wherein the standard template is a preset banknote template satisfying a set condition, and the characteristic value is a value for indicating a state corresponding to a feature of the standard template; and displaying the characteristic value and an original sorting parameter corresponding to the characteristic value at the same time, so as to make an operator compare the characteristic value with the original sorting parameter corresponding to the characteristic value, thereby deciding whether reset the original sorting parameter, wherein the original sorting parameter is a sorting parameter preset in the banknote sorting apparatus for sorting banknotes;

resetting the original sorting parameter based on the information inputted by the operator, if receiving an instruction to reset the original sorting parameter.

2. The method according to claim 1, wherein the obtaining the characteristic value of the standard template comprises:

collecting at least one of image data and magnetic data of the standard template; and performing analytical processing on at least one of the image data and the magnetic data to obtain the characteristic value of the standard template.

3. The method according to claim 1, wherein the displaying the characteristic value and the original sorting parameter corresponding to the characteristic value comprises:

displaying the characteristic value and the original sorting parameter corresponding to the characteristic value in groups, wherein each group of displayed contents comprises one characteristic value and an original sorting parameter corresponding to the characteristic value.

4. The method according to claim 1, after acquiring the characteristic value of the standard template, further comprising: comparing the characteristic value with the original sorting parameter corresponding to the characteristic value; and the displaying the characteristic value and the original sorting parameter corresponding to the characteristic value comprises: displaying the characteristic value and the original sorting parameter corresponding to the characteristic value if a difference value between the characteristic value and the original sorting parameter corresponding to the characteristic value exceeds a preset value.

5. The method according to claim 1, wherein when displaying the characteristic value and the original sorting parameter corresponding to the characteristic value, the displayed characteristic value is in an editable state; and after displaying the characteristic value in the editable state, the method comprises:

outputting prompt message, wherein the prompt message is used for prompting whether to set the original sorting parameter; and wherein the resetting the original sorting parameter based on the information inputted by the operator, if receiving an instruction to reset the original sorting parameter, comprises:

receiving input information, wherein the input information comprises a characteristic value after editing and modifying the characteristic value in the editable state; and setting the original sorting parameter according to the input information.

6. A banknote sorting apparatus, wherein a conveying passage for conveying banknotes is arranged in the banknote sorting apparatus; and the banknote sorting apparatus comprises:

a banknote inlet arranged at a starting end of the conveying passage and configured to stack banknotes to be sorted;

a first banknote outlet connected with the conveying passage through a first banknote outing passage and configured to accumulate first kind of banknotes obtained by sorting according to a sorting parameter;

a second banknote outlet located downstream of the first banknote outlet along a banknote conveying direction, connected with the conveying passage through a second banknote outing passage and configured to accumulate second kind of banknotes obtained by sorting according to the sorting parameter;

a control unit for acquiring a characteristic value of a standard template, wherein the standard template is a preset banknote template satisfying a set condition, and the characteristic value is a value for indicating a state corresponding to a feature of the standard template; and a human-machine interaction unit, wherein the human-machine interaction unit comprises a display unit for displaying the characteristic value and an original sorting parameter corresponding to the characteristic value at the same time, so as to make an operator compare the characteristic value with the original sorting parameter corresponding to the characteristic value, thereby deciding whether reset the original sorting parameter, and the original sorting parameter is a sorting parameter preset in the banknote sorting apparatus for sorting banknotes;

the human-machine interaction unit is further configured to reset the original sorting parameter based on the information inputted by the operator, if receiving an instruction to reset the original sorting parameter.

7. The banknote sorting apparatus according to claim 6, further comprising:

a collection unit configured to collect at least one of image data and magnetic data of conveyed banknotes; and the control unit is configured to perform analytical processing on at least one of the image data and the magnetic data to obtain the characteristic value of the standard template.

8. The banknote sorting apparatus according to claim 6, wherein the display unit is configured to display the characteristic value and the original sorting parameter corresponding to the characteristic value in groups, wherein each group of displayed contents comprises one characteristic value and an original sorting parameter corresponding to the characteristic value.

9. The banknote sorting apparatus according to claim 6, wherein the control unit is configured to compare the characteristic value with the original sorting parameter corresponding to the characteristic value; and the display unit is configured to display the characteristic value and the original sorting parameter corresponding to the characteristic value when a difference value between the characteristic value and the original sorting parameter corresponding to the characteristic value exceeds a preset value.

10. The banknote sorting apparatus according to claim 6, wherein the display unit is configured to display a characteristic value in an editable state when displaying the characteristic value and the original sorting parameter corresponding to the characteristic value;

the human-machine interaction unit is configured to output prompt message and receive input information, wherein the prompt message is used for prompting whether to reset the original sorting parameter; the input information comprises a characteristic value after editing and modifying the characteristic value in the editable state; and the control unit is configured to reset the original sorting parameter according to the input information.

* * * * *